US005325165A

United States Patent [19]

Ohgita et al.

[11] Patent Number: 5,325,165

[45] Date of Patent: Jun. 28, 1994

[54] ELECTROPHOTOGRAPHIC PRINTING MACHINE PROVIDING BOTH MONOCHROME AND COLOR IMAGES

[75] Inventors: Toshiki Ohgita, Shiki; Hideo Matsuda, Nara; Takashi Kubo, Soraku; Yoshiaki Masuda, Nara; Hidetoshi Kaneko, Ayama; Kazunori Iwasa, Yamatokoriyama; Kazunori Soda, Nara; Tokiyuki Okano; Tomiyuki Ishikawa, both of Yamatokoriyama, all of Japan

[73] Assignee: Sharp Kabushiki Kaisha, Osaka, Japan

[21] Appl. No.: 27,824

[22] Filed: Mar. 8, 1993

[30] Foreign Application Priority Data

Mar. 10, 1992 [JP] Japan ..... 4-051764
Jul. 6, 1992 [JP] Japan ..... 4-178564
Jul. 13, 1992 [JP] Japan ..... 4-185472

[51] Int. Cl.[5] ..... G03G 15/20

[52] U.S. Cl. ..... 355/285; 219/216; 355/319; 355/326 R

[58] Field of Search ..... 355/204, 208, 282, 284, 355/285, 290, 319, 326, 327; 219/216, 469; 432/60; 118/60, DIG. 1

[56] References Cited

U.S. PATENT DOCUMENTS 3,965,331 6/1976 Moser et al. ..... 219/216
4,526,459 7/1985 Bresnick ..... 219/216 X
4,806,969 2/1989 Tomoyori et al. ..... 219/216 X
4,908,660 3/1990 Ohira et al. ..... 355/319 X
4,928,148 5/1990 Higashi ..... 355/290
5,103,267 4/1992 Wada et al. ..... 355/319 X
5,162,859 11/1992 Hirono et al. ..... 355/319 X

FOREIGN PATENT DOCUMENTS 0139223 5/1985 European Pat. Off. ..... 355/319
0017472 1/1985 Japan ..... 355/284
0296281 11/1989 Japan ..... 355/282

*Primary Examiner*—A. T. Grimley
*Assistant Examiner*—William J. Royer
*Attorney, Agent, or Firm*—David G. Conlin; George W. Neuner

[57] ABSTRACT

A copying machine as an example of electrophotographic printing machines is composed of a main body which permits both black-and-white copying and full color copying, and a reverse and retransport unit provided under the main body, for reversing and retransporting a sheet after being copied on one surface thereof to the main body. The main body has a fixing means including upper and lower fixing portions formed between three heat rollers. The lower fixing portion placed closer to the reverse and retransport unit is associated with the black-and-white copying, and the upper fixing portion is associated with the full color copying. Upper and lower discharge transport paths for discharging the sheet out of the device are provided so as to respectively extend from the upper and lower fixing portions. Further, a retransport path is provided so as to extend from the lower fixing portion. Since the above three paths are provided without having any crossing point, the structure of the paths is simplified. Furthermore, when carrying out a black-and-white copying on one surface of the sheet and a color copying on the other surface, the black-and-white copying is carried out first, thereby eliminating the problem of the sheet being stuck in the device.

41 Claims, 10 Drawing Sheets

ELECTROPHOTOGRAPHIC PRINTING MACHINE PROVIDING BOTH MONOCHROME AND COLOR IMAGES

FIELD OF THE INVENTION

The present invention relates to an electrophotographic printing machine which permits both monochrome image forming process and color image forming process, and particularly to an electrophotographic printing machine having fixing means having a portion for fixing monochrome images and a portion for fixing color images.

BACKGROUND OF THE INVENTION

The copying machine shown in FIG. 8 is known as a conventional electrophotographic machine wherein upper and lower heat rollers 914*a* and 914*b* are provided on a fixing means 914. The copying machine permits both black-and-white copying and full color copying. The copying machine is arranged so as to scan a document placed on a document platen 903 using a lamp 902 of an optical system 901. Further, a photoreceptor 905 is exposed using a light reflected from the document through a filter 904, thereby forming an electrostatic latent image on the surface of the photoreceptor 905. The electrostatic latent image is developed using a color toner in developers 906 through 908, or using a black toner in a developer 909 so as to form a toner image. The toner image is transferred on a sheet supplied from one of sheet cassettes 911 through 913 through an intermediate transfer belt 910. The upper and lower heat rollers 914*a* and 914*b* of the fixing means 914 are in tight contact with one another. The toner of the toner image is melted in a fixing portion provided between the heat rollers 914*a* and 914*b*, whereby the toner image is permanently affixed onto the sheet.

On the other hand, the copying machines disclosed in U.S. Pat. No. 3,965,331 and Japanese Laid-Open patent publication 98036/1976 (Tokukaisho 51-98036) have the following arrangement: A fixing means is provided with upper, intermediate, and lower heat rollers. An upper fixing portion is formed between the upper and intermediate heat rollers, and a lower fixing portion is formed between the intermediate and lower heat rollers. A transport belt for conveying the sheet either to the upper fixing portion or to the lower fixing portion can be moved up and down according to the fixing portion to be used. In the above arrangement, by selecting an appropriate material for the upper, intermediate, and lower heat rollers, the copying machines can be made applicable to recording material made of various material such as paper, polycarbonate, polyethyleneterephthalate, etc.

However, in the above-type of fixing means provided with the three heat rollers, when both of the upper and lower fixing portions are made applicable to both full color copying and black-and-white copying in order to enable both full color copying and black-and-white copying, the following problems will arise as in the case of the aforementioned type of fixing means provided with two heat rollers.

Because a control is required in each fixing portion according to a selected copying mode, i.e., black-and-white copying or full color copying, the control system becomes complicated, or an appropriate fixing process is difficult to be obtained.

Because the heat roller for full color copying is arranged so as to make a three-layered color toner adhere onto the sheet without adhering onto the surface of the heat roller, i.e., without offsetting the toner image, a smooth surface is required for the heat roller. This results in a higher manufacturing cost and a lower durability compared with the heat roller for black-and-white copying. Therefore, in the case where the heat roller for full color copying is adopted for both upper and intermediate heat rollers in order to make the upper and lower fixing portions applicable to both full color copying and black-and-white copying, a frequent exchange is required for both of the heat rollers. Moreover, a high cost is required for processing the black-and-white copying.

Furthermore, compared with the black toner used in the monochrome copying, the softening temperature and the melting viscosity of the color toner used in the full color copying are required to be set significantly lower in order to fully mix it for the three-layered color toner. Therefore, the offset is likely to be generated, and in order to surely prevent this, a large amount of silicone oil is required for both of the upper and intermediate heat rollers when a fixing process for full color copying is carried out in both of the upper and lower fixing portions. For this reason, in both cases where the fixing process for black-and-white copying is carried out in the upper fixing portion and in the lower fixing portion, the silicone oil used in the fixing process for the full color copying adheres onto both surfaces or one surface of the sheet. Furthermore, when copying on both sides of the sheet, the silicone oil adhering onto the sheet will adhere onto a transport roller in a retransport path. If this happens, the transporting ability is lowered, and the sheet is likely to get stuck in the apparatus. Moreover, if the silicone oil adheres onto the photoreceptor, etc., or gets inserted in the developer vessel, the image quality will be lowered.

In the copying machines designed for both black-and-white copying and full color copying, in order to prevent the above problems, the fixing means provided with the upper, intermediate, and lower heat rollers is arranged such that either one of the upper and lower fixing portions is associated with the black-and-white copying, and the other fixing portion is associated with the full color copying as disclosed in Japanese Laid-open Patent application 191979/1990 (Tokukaihei 2-191979) and U.S. Pat. No. 4,928,148.

However, with the above-type of copying machine, in the case where a reverse and retransport unit is provided for reversing the recording material discharged from the fixing means and retransporting it to the main body in order to enable the image to be formed on both sides of the copying material in the black-and-white copying process, the transport path for the copying material discharged from the fixing means becomes highly complicated.

More concretely, with the above arrangement, two discharge transport paths for guiding the recording material out of the device, one being associated with the full color copying and the other being associated with the black-and-white copying, and a retransport path for guiding the copying material to the reverse and retransport unit in the both sided copying mode are provided on the recording material discharge side of the fixing means. In this case, since these paths cross, the structure of the paths is complicated, and the apparatus becomes larger in size. Thus, a high manufacturing cost is required. Moreover, the copying material is likely to get stuck in the apparatus, and the clearing of the copy material when this happens is also difficult.

Depending on the use of the copied image, such copying may be demanded wherein a black-and-white image is copied on one side of the recording material, and a full color image is copied on the other side of the copying material. Therefore, the development of a device which enables the above copying without presenting the above problems is desired.

Furthermore, in a successive image forming process wherein single sided black-and-white image forming processes and the single sided full color image forming processes are combined (mixed copying process) with respect to a plurality of documents including monochrome documents and color documents, the following problems arise. Each time switching from the full color copying to black-and-white copying, or from the black-and-white copying to the full color copying, the transport belt is required to be moved. Moreover, because each of the heat rollers is switched off when it is not used, readjustment of the temperature is required. Therefore, a long time is required for the mixed copying process.

SUMMARY OF THE INVENTION

A first object of the present invention is to provide an electrophotographic printing machine which permits a simplification of the structure of transport paths on the recording material discharge side of a fixing means, the electrophotographic printing machine permitting both single sided and both sided monochrome image forming processes, and a single sided color image forming process, the fixing means being provided with respective fixing portions for forming the monochrome image and for forming the color image.

A second object of the present invention is to provide an electrophotographic printing machine which permits a both sided monochrome/color image forming process wherein a monochrome image is formed on one surface of a recording material and a color image is formed on the other surface of the recording material without making the recording material get stuck in the apparatus, etc.

A third object of the present invention is to provide an electrophotographic printing machine which permits a reduction of a time required for a mixed image forming process, the electrophotographic printing machine permitting at least a single sided monochrome image forming process and a single sided color image forming process, and a successive image forming process (mixed copying process) wherein the monochrome image forming processes and the color image forming processes are combined with respect to a plurality of documents including both monochrome documents and color documents, the electrophotographic printing machine being provided with a fixing means which includes fixing portions respectively designed for forming the monochrome image and for forming the color image.

In order to achieve the first object, the electrophotographic printing machine in accordance with the present invention is characterized by comprising:

toner image forming means for selectively forming a monochrome toner image or a color toner image on a surface of a recording material;

fixing means which includes a first fixing portion and a second fixing portion, the first fixing portion being used for fixing a color toner image onto the surface of the recording material, and the second fixing portion being used for fixing a monochrome image onto the surface of the recording material;

recording material transport means for conveying the recording material with the color toner image thereon to the first fixing portion and for conveying the recording material with the monochrome image thereon to the second fixing portion;

reverse and retransport means for reversing the recording material having passed through the second fixing portion and retransporting it to the toner image forming means;

a first discharge transport path for guiding the recording material having passed through the first fixing portion out of the device;

a second discharge transport path for guiding the recording material having passed through the second fixing portion out of the device;

a retransport path for guiding the recording material having passed through the second fixing portion to the reverse and retransport means;

transport direction switching means for switching a transport direction of the recording material having passed through the second fixing portion between the second discharge transport path and the retransport path; and control means for controlling respective operations of the toner image forming means, fixing means, recording material transport means, reverse and retransport means, and transport direction switching means according to a process selected between monochrome and color, and between single sided and both sided of the recording material, and wherein:

the second fixing portion is provided closer to the reverse and retransport means than the first fixing portion.

According to the above arrangement, since the second fixing portion is located closer to the reverse and retransport means than the first fixing portion, the first discharge transport path, the second discharge transport path, and the retransport path can be provided without having a crossing point, and this permits the simplification of the structure of the paths.

The first fixing portion is designed only for forming the color image, and the second fixing portion is designed only for forming the monochrome image- This permits to separately set the respective conditions for the color image forming process of the first fixing portion and the monochrome image forming process of the second fixing portion- Therefore, a complicated control system is not required for the fixing means. This enables the optimum fixing process to be achieved in both color image forming process and the monochrome image forming process The electrophotographic printing machine of the present embodiment may be arranged such that the fixing means includes first through third fixing rollers, and fixing roller drive means for rotating the first through third fixing rollers; the first fixing roller is in tight contact with the second fixing roller, and the second fixing roller is in tight contact with the third fixing roller; and the first fixing portion is formed in a contacting portion between the first fixing roller and the second fixing roller, whereas, the second fixing portion is formed in a contacting portion between the second fixing roller and the third fixing roller.

Furthermore, in the case where the arrangement is made so as to supply an oil to the first fixing roller, the oil is not likely to adhere to the recording material to be processed in the second fixing portion. The occurrence of the recording material being stuck in the apparatus due to the oil can be eliminated, and therefore, the reduction of the image quality due to the application of the oil can be prevented.

For the second fixing portion for forming the monochrome image, a durable and low-priced fixing roller can be used. Thus, the second fixing portion is not required to be frequently exchanged with a new one. This also permits a reduction of the cost for the monochrome image forming process.

In order to achieve the second object, the electrophotographic printing machine in accordance with the present invention having the aforementioned configuration is characterized in that a both sided monochrome/-color image forming process is permitted, wherein a monochrome image is formed on one surface of a recording material and a color image is formed on the other surface of the recording material, and in the both sided monochrome/color image forming process, the control means controls the toner image forming means, fixing means, recording material transport means, reverse and retransport means, and transport direction switching means so that after forming the monochrome image on one surface of the recording material, the color image is formed on the other surface of the recording material.

The above arrangement eliminates the possibility that the recording material with the color image thereon which is easily rolled or with the oil adhering to the surface thereof is transported to the retransport path or the reverse and retransport means. This prevents the recording material from being stuck in the retransport path or the reverse and retransport means, thereby enabling a highly reliable both sided monochrome/-color image forming process.

In the both sided monochrome/color image forming process, the process for forming the monochrome image on one surface of the recording material, and the process for forming the color image on the other surface of the recording material are carried out in this order. In this case, the recording material with the monochrome toner image thereon by the image forming means is first transported to the second fixing portion of the fixing means where the fixing process is carried out, then transported to the reverse and retransport means through the retransport path. Thereafter, the color toner image is formed on the other surface of the recording material by the image forming means. Then, after the fixing process is carried out on the recording material by the first fixing portion of the fixing means, the recording material is discharged out of the apparatus.

In the both sided monochrome/color image forming process, the possibility that the recording material with the color image thereon which is easily rolled or with the oil adhering to the surface thereof is transported to the retransport path or to the reverse and retransport means is eliminated. This prevents the recording material from being stuck in the retransport path or in the reverse and retransport means, thereby enabling a highly reliable both sided monochrome/color image forming process.

The color image is formed by making the toner layer permanently adhere to the recording material, the toner layer being composed of a plurality of layers (three layers in the case of full color image). Therefore, the recording material with the color image thereon shows a greater percentage of shrinkage on the surface than the back surface, and the recording material is thus easily rolled. On the other hand, the monochrome image (for example, black-and-white image) is formed by making the toner layer of a single layer permanently affixed to the recording material. Therefore, the recording material with the monochrome image thereon is not likely to be rolled. Thus, the recording material with the monochrome image thereon can be appropriately transported to the retransport path and to the reverse and retransport means. On the other hand, when transporting the recording material with the color image thereon to the retransport path and to the reverse and retransport means, the recording material is likely to get stuck therein.

Moreover, when it is arranged such that an oil is supplied to the first fixing roller, the oil is likely to adhere to the surface of the recording material with the color image thereon. If the recording material is transported to the retransport path and the reverse and retransport means, because of the oil, the recording material is likely to get stuck in the apparatus, and the image quality is reduced. In order to prevent this, the present invention is arranged such that after forming the monochrome image on one surface of the recording material, the color image is formed on the other surface of the recording material. In this way, since the recording material with the color image thereon is not required to be transported to the retransport path nor to the reversing and retransport path, the above problems will not arise.

In order to achieve the third object, the electrophotographic printing machine in accordance with the present invention is characterized by comprising:

image forming means for selectively forming a monochrome image or color image on a surface of the recording material;

fixing means including a first fixing portion and a second fixing portion, the first fixing portion being used for fixing both monochrome and color images onto the surface of the recording materials, and the second fixing portion being used for fixing a monochrome image onto the surface of the recording material;

recording material transport means for conveying both the recording material with a color image thereon and the recording material with the color image thereon to the first transport portion, and for conveying only the recording material with the monochrome image thereon to the second transport portion; and control means for controlling respective operations of the image forming means, fixing means, and recording material transport means according to a process selected between monochrome and color, and wherein:

in the successive image forming process wherein monochrome image forming processes and color image forming processes are combined, the control means controls the recording material transport means so that all the recording materials with the monochrome or color images thereon are transported to the first fixing portion, and controls the fixing means so that the monochrome and color images formed on the recording materials are permanently affixed thereto in the first fixing portion.

With the above arrangement, when a successive image forming process wherein monochrome image forming processes and color image forming processes are combined, the switching of the transporting direction of the recording material in the recording material transport means nor switching between the first fixing portion and the second fixing portion in the fixing means is required, thereby enabling a prompt successive copying process with a reduced time loss.

For a fuller understanding of the nature and advantages of the invention, reference should be made to the ensuing detailed description taken in conjunction with the accompanying drawings.

BRIEF DESCRIPTION OF THE DRAWINGS

FIG. 1 is a view showing a schematic configuration of a portion surrounding a fixing means of the copying machines of the embodiments in accordance with the present invention.

FIG. 2 is a view showing an entire configuration of the copying machine provided with the fixing means.

FIG. 3 is an enlarged view showing the copying machine main body of FIG. 2.

FIG. 4 is a schematic block diagram showing essential parts of the control system of the copying machine of FIG. 2.

FIG. 5 is a cross sectional view showing a schematic configuration of three fixing rollers of the fixing means.

FIG. 6 is a schematic perspective view of a document used in the explanation of the mixed copying process carried out in the copying machine of another embodiment in accordance with the present invention.

FIGS. 7(*a*)–7(*d*) are flow charts showing control processes of a control unit of the copying machine: FIG. 7(*a*) shows a control process in a black-and-white copying mode; FIG. 7(*b*) shows a control process in a full color copying mode; FIG. 7(*c*) shows a control process in a black-and-white/full color copying mode; and FIG. 7(*d*) shows a control process in a mixed copying mode.

DESCRIPTION OF THE EMBODIMENTS

The following description will discuss an embodiment of the present invention with reference to FIGS. 1 through 5.

Figure 2:
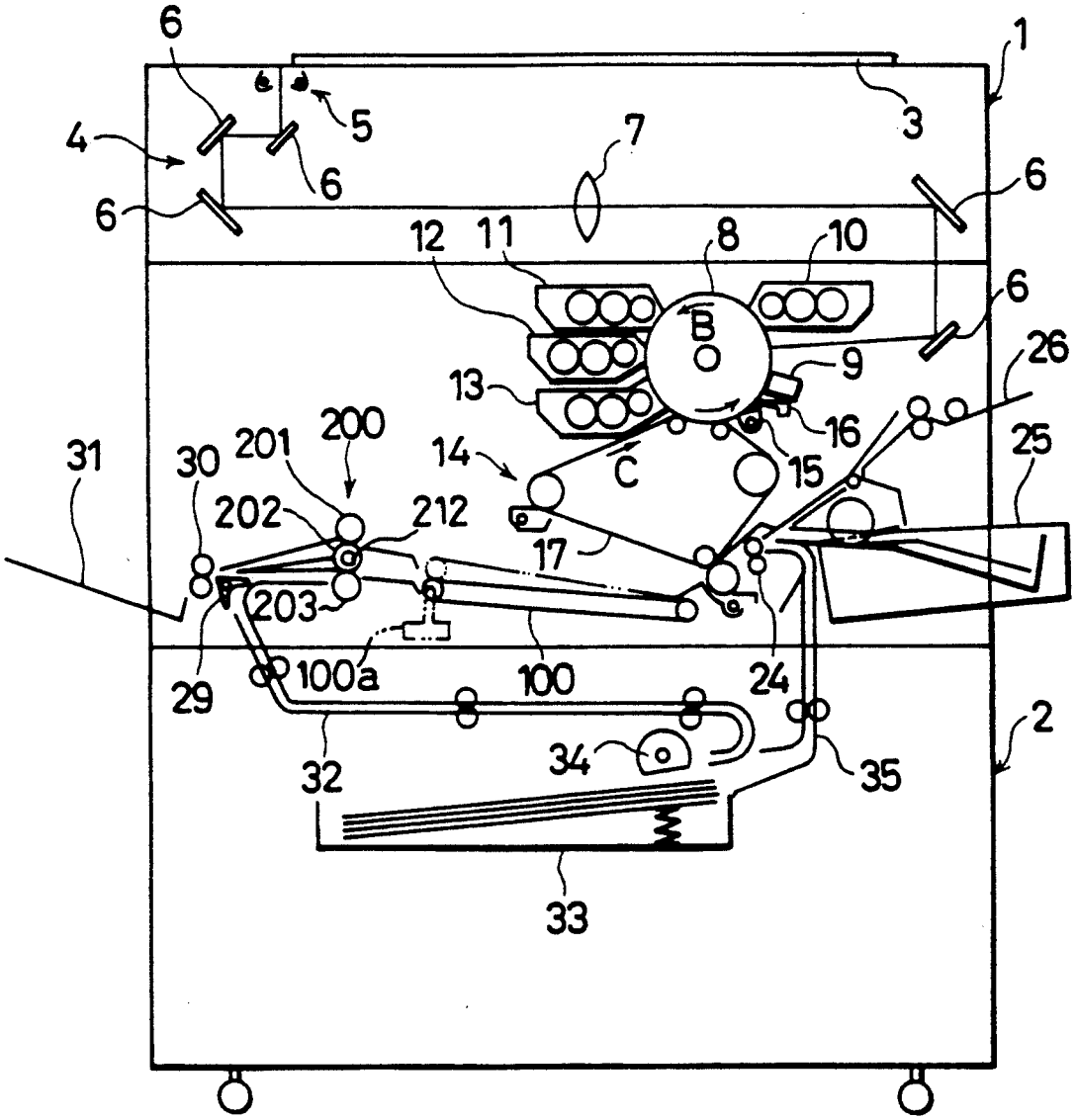

As an example of electrophotographic printing machines, a full color copying machine (hereinafter simply referred to as copying machine) in accordance with the present embodiment is provided with a main body 1 (image forming means), and a reverse and retransport unit 2 (reverse and retransport means) placed under the main body 1 as shown in FIG. 2.

Figure 3:
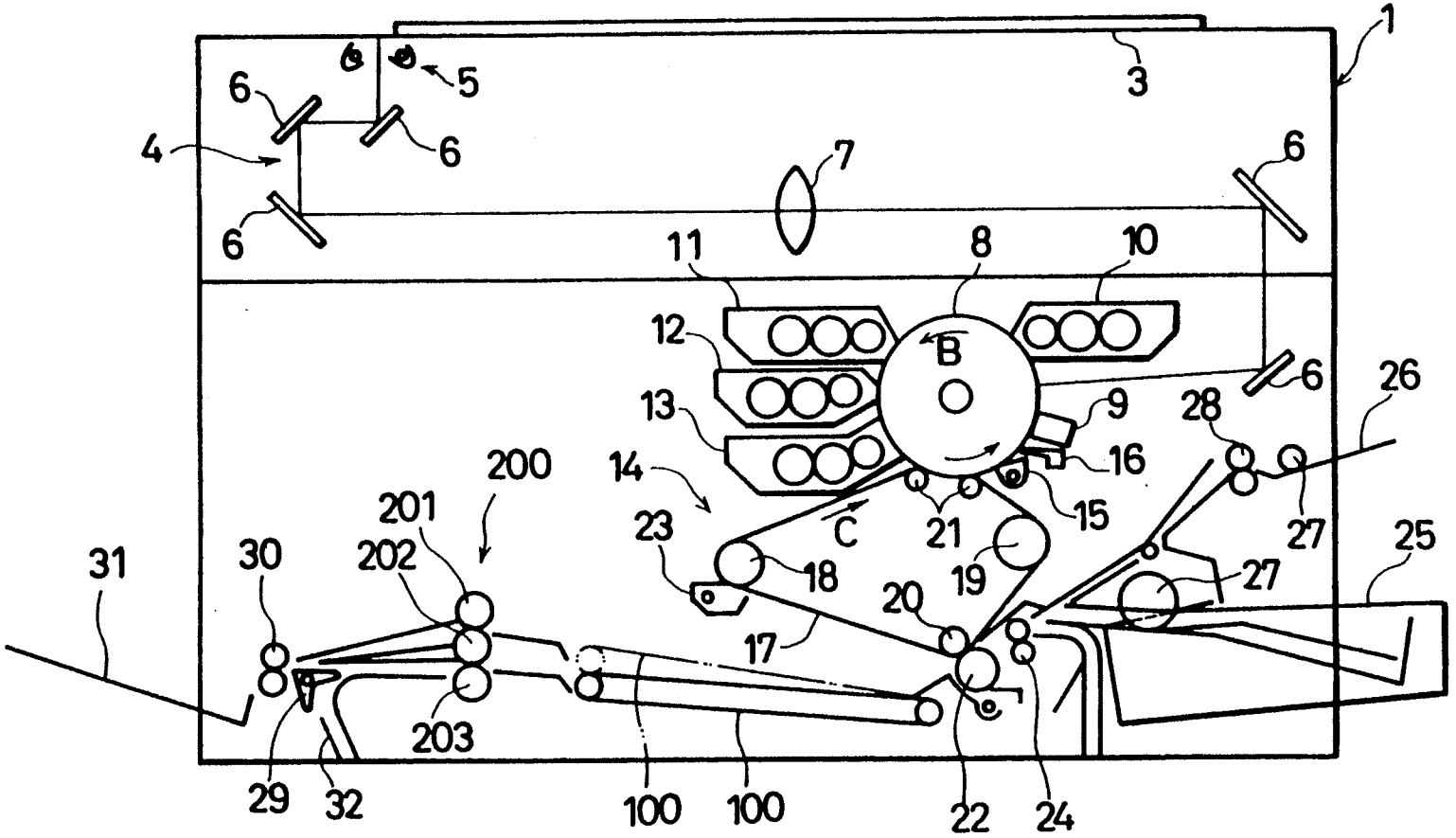

As shown in FIG. 3, the main body 1 includes a document platen 3 and an exposure-use optical system 4. The document platen 3 is made of hard transparent glass, and is provided on the upper surface of the main body 1. The optical system 4 is provided under the document platen 3. The optical system 4 includes a lamp unit 5, a plurality of reflecting mirrors 6, and a lens unit 7. The lamp unit 5 is provided for scanning a document (not shown) placed on the document platen 3 by projecting thereto a light. The reflecting mirrors 6 are provided for guiding a light reflected from the document to a photoreceptor 8. The lens unit 7 is provided in the light path of the reflected light.

Along the circumference of the photoreceptor 8, a charger 9 is provided for charging the surface of the photoreceptor 8 in a predetermined potential. Further, in the rotating direction of the photoreceptor 8 from the charge 9, an eraser (not shown), a black developer vessel 10, a yellow developer vessel 11, a magenta developer vessel 12, a cyan developer vessel 13, an intermediate transfer unit 14, a cleaning unit 15, and an eraser 16 are provided in this order.

The intermediate transfer unit 14 includes a transfer belt 17, rollers 18 through 20 for supporting the transfer belt 17, first transfer rollers 21, a second transfer roller 22, and a cleaning unit 23. The first transfer rollers 21 are provided for making the transfer belt 17 in tight contact with the photoreceptor 8 and for transferring a toner image formed on the surface of the photoreceptor 8 to the transfer belt 17. The second transfer roller 22 which is in tight contact with the roller 20 when transferring the toner image on a sheet (recording material), for transferring the toner image on the surface of the transfer belt 17 to the sheet. The cleaning unit 23 is provided for removing the toner remaining on the surface of the transfer belt 17.

On the sheet feed side of the intermediate transfer unit 14, a register roller 24, a feed cassette 25, and a feed tray 26 are provided. The register roller 24 is provided for feeding a sheet to the intermediate transfer unit 14 in a predetermined timing. Further, feed rollers 27 and a transport roller 28 are provided in the vicinity of the feed cassette 25 and the feed tray 26.

Along a sheet discharge direction from the intermediate transfer unit 14, a suction unit 100, (recording material transport means), a fuser 200, a switching gate 29 (transport direction switching means), a discharge roller 30, a discharge tray 31, and a retransport path 32 are provided.

As shown in FIG. 2, the retransport path 32 is extended to the intermediate tray 33 of the reverse and retransport unit 2. The retransport path 32 is provided for transporting the sheet having gone through the process in the fuser 200 and for discharging the sheet onto the intermediate tray 33. Here, the orientation of the sheet is such that the toner images are always on the upper surface thereof. The sheet conveyed through the retransport path 32 is placed on the intermediate tray 33. Then, the sheet is transported through the reverse and retransport path 35 by the feed roller 34 (recording material feeding means). A reverse and retransport path 35 is provided for reversing the sheet sent from the intermediate tray 33 and for transporting the reversed sheet to the register roller 24.

Figure 1:
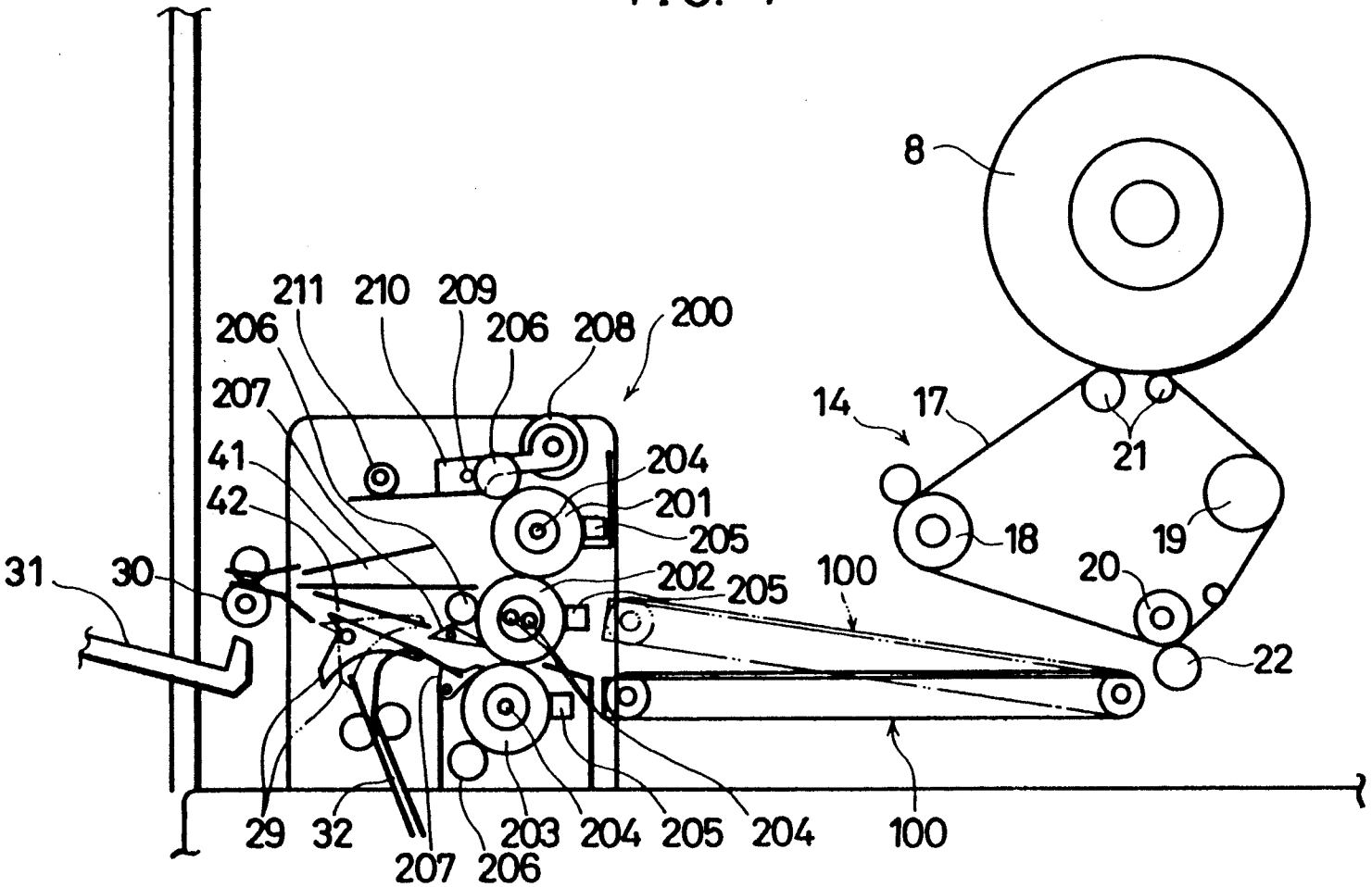
FIGS. 1 through 7(*d*) show embodiments of the present invention.

The suction unit 100 transports the sheet to the fuser 200 by moving a belt with no ends (not shown). As shown in FIG. 1, the suction unit 100 is arranged so as to rotate between the upper position and the lower position with the end thereof on the sheet feed side as an axis. The upper position is set in such a position that the sheet can be transported to an upper fixing portion 200*a*, to be described later, (see FIG. 5) of the fuser 200. The lower position is set in such a position that the sheet can be transported to an lower fixing portion 200*b*, to be described later, (see FIG. 5) of the fuser 200. As shown in FIG. 2, the suction unit 100 is rotated between the upper position and the lower position by activating a suction driving unit 100*a* (transport belt driving means), the suction unit 100 being composed of a cam unit, or solenoid, etc., provided on the lower surface side of the suction unit 100. Although it is not shown in the figure, a position sensor is provided in the vicinity of the suction unit 100 for detecting the position of the suction unit 100.

As shown in FIG. 1, the fuser 200 includes an upper heat roller 201 (first fixing roller), an intermediate heat roller 202 (second fixing roller), and a lower heat roller 203 (third fixing roller). The heat rollers 201 through 203 are provided so as to be parallel and align in up-down direction.

Figure 5:
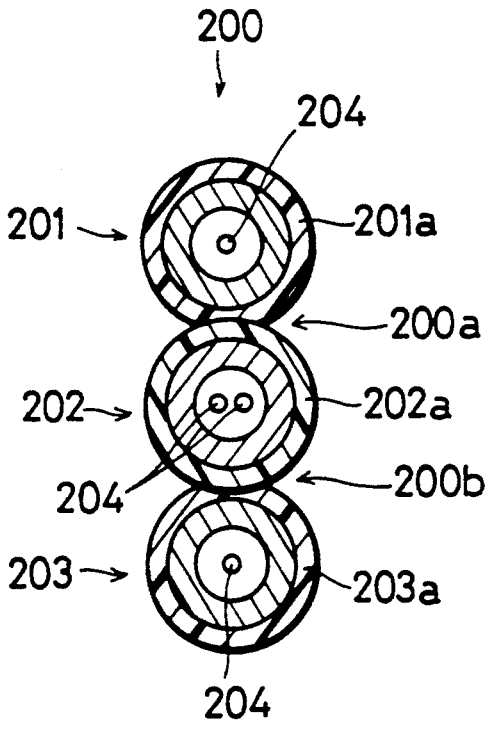

In the fuser 200, as shown in FIG. 5, the upper heat roller 201 and the intermediate heat roller 202 are in tight contact with one another. Similarly, the intermediate heat roller 202 and the lower heat roller 203 are in tight contact with one another. The upper fixing portion 200*a* formed in a contacting portion between the upper heat roller 201 and the intermediate heat roller 202 is designed for full color copying. On the other hand, the lower fixing portion 200*b* formed in a contacting portion between the intermediate heat roller 202 and the lower heat roller 203 is designed for black-and-white copying.

In the fuser 200, in order to enable both full color copying and black-and-white copying, the following materials are used for surface layers: Silicone rubber (elastic material) is used for the surface layer 201*a* of the upper heat roller 201; polytetrafluoroethylene (inelastic material) is used for the surface layer 202*a* of the intermediate heat roller 202; and a rubber such as a silicone rubber is used for the surface layer 203*a* of the lower heat roller 203.

The surface of the upper heat roller 201 is preferably made smooth so that the three-layered toner image can easily be separated therefrom when making the full color image permanent on the sheet compared with the surface of the lower heat roller 203 for black-and-white copying.

As shown in FIG. 1, the heat rollers 201 through 203 are arranged so that the respective central portions thereof form a cavity, and a stick-type heat lamp 204 (heater) is provided in each cavity of the upper and lower heat rollers 201 and 203. Further, a pair of heat lamps 204 are provided in the intermediate heat roller 202 in order to enable both full color copying and black-and-white copying.

Along the circumferences of the heat rollers 201 through 203, thermisters 205, thermostats (not shown), and cleaning rollers 206 are provided. The thermisters 205 are provided for detecting the surface temperatures thereof. The thermisters are provided in a circuit of the heat lamps for preventing an overheating. The cleaning rollers 206 are provided for removing toner, etc. remaining on the surfaces of the heat rollers 201 through 203.

Along the circumferences of the intermediate heat roller 202 and the lower heat roller 203, a nail 207 is provided for separating the sheet from the roller surface. On the other hand, a silicone oil moistened oil application roller 208 (oil supply means) is provided along the circumference of the upper heat roller 201.

The oil application roller 208 is provided for applying a silicone oil on the surface of the upper heat roller 201 so as to ensure the adherence of the color toner onto the heat roller surface. Namely, the separation of the color toner image is ensured by preventing offsetting, and the full color copied images are made glossy. The oil application roller 208 is attached to one end of a roller holder 210 which rotates around a shaft 209. When the upper fixing portion 200*a* is used, the oil application roller 208 is made in tight contact with the upper heat roller 201 by a roller drive mechanism. Here, the roller driving mechanism (oil application roller drive means, oil supply means) is composed of an eccentric cam 211 provided on the other end of the roller holder 210 and a spring (not shown). On the other hand, when the upper fixing portion is not used, the oil application roller 208 is separated from the upper heat roller 201.

The copying machine is provided with a drive motor 212 (fixing roller drive means) for driving the intermediate heat roller 202 in normal and reverse directions according to a fixing portion selected between the upper fixing portion 200*a* and the lower fixing portions 200*b*. In addition, the rotations of the upper and lower heat rollers 201 and 203 are driven with the rotations of the intermediate heat roller 202.

An upper discharge transport path 41 (first discharge transport path) is provided between the upper fixing portion 200*a* and the discharge roller 30. A lower discharge transport path 42 (second discharge transport path) is provided between the lower fixing portion 200*b* and the discharge roller 30. The lower discharge transport path 42 is branched into the retransport path 32 extending downward. At a branch point between the lower discharge transport path 42 and the retransport path 32, a switching gate 29 (transport direction switching means) is provided for switching the transport direction of the sheet fed from the lower fixing portion 200*b* between the lower discharge transport path 42 and the retransport path 32.

In the copying machine of the present embodiment, the following copying modes are permitted: a single sided black-and-white image copying mode and a single sided full color image copying mode; both sided black-and-white image copying mode; and both sided black-and-white/full color image copying mode (both sided monochrome/color image forming process) wherein the black-and-white image is copied on one surface of the sheet, and the full color image is copied on the other surface of the sheet.

Figure 4:
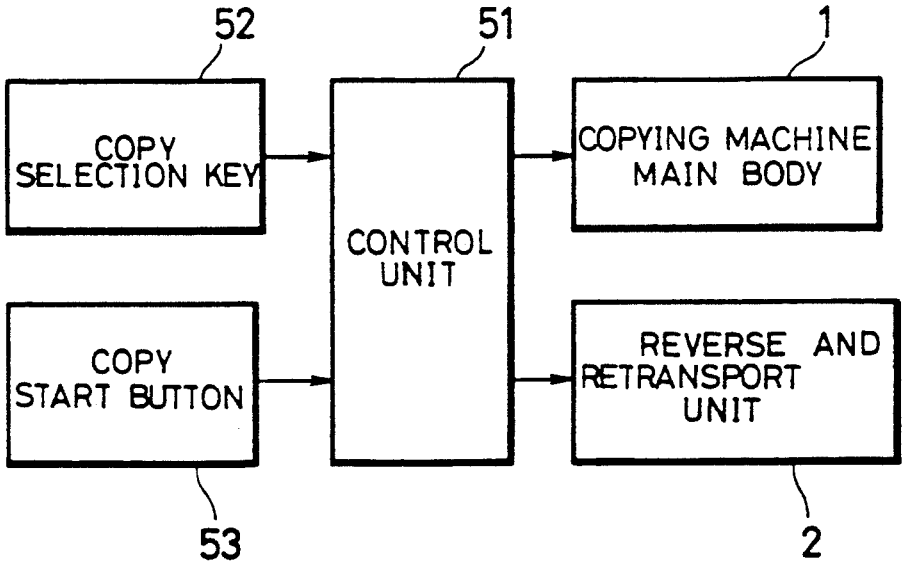

In order to enable the above copying modes, as shown in FIG. 4, the main body 1 is provided with a control unit 51 (control means) such as a microcomputer, for controlling the main body 1 and the reverse and retransport unit 2 according to a program set beforehand.

Based on a signal from the position sensor, thermisters 205, a copy selection key 52, a copying start button 53, etc., the control unit 51 controls the respective rotation directions of the heat rollers 201 through 203, temperature adjustment, and position control of the suction unit 100. When the both sided black-and-white/full color copying mode is selected by the copy selection key 52, the control unit 51 controls the main body 1 and the reverse and retransport unit 2 so that after the black-and-white image is copied on one surface of the sheet, the full color image is copied on the other surface of the sheet.

With the above arrangement of the copying machine of the present invention, first a full color copying process will be explained below.

After the full color copying mode is selected by the copy selection key 52 shown in FIG. 4, the copy start button 53 is pressed ON. Then, the intermediate heat roller 202 is rotated in the counterclockwise direction. With the rotation of the intermediate heat roller 202, the upper heat roller 201 is rotated in the clockwise direction. Further, the oil application roller 208 is made in tight contact with the upper heat roller 201, and the suction unit 100 is rotated to the upper position.

The surface of the photoreceptor 8 which rotates in the direction of B is uniformly charged by the charger 9, and a first scanning of the document placed on the document platen 3 is carried out by the optical system 4. A light reflected from the document is projected onto an exposing point on the surface of the photoreceptor 8 between the charger 9 and eraser (not shown) through a blue color decomposing filter (not shown) and a slit (not shown) so as to expose the photoreceptor 8, thereby forming a static latent image. The charge remaining in the area outside the image forming area of the photoreceptor 8 is removed by the eraser (not shown). Thereafter, the static latent image is developed by the yellow vessel 11, thereby forming a yellow toner image.

Next, the yellow toner image on the surface of the photoreceptor 8 is transferred onto the transfer belt 17 circulating in direction C by the first transfer rollers 21 having applied thereto a minus high voltage. Additionally, the toner remaining on the surface of the photoreceptor 8 is removed by a cleaning unit 15, and the potential remaining on the surface of the photoreceptor 8 is removed by the eraser 16.

When the above sequential process is completed, the photoreceptor 8 is charged again by the charger 9, and a second scanning is carried out on the document by the optical system 4. In this case, a green color decomposing filter is used, and a static latent image formed on the photoreceptor 8 is developed by a magenta toner of the magenta developer vessel 12, thereby forming a magenta toner image. The magenta toner image formed on the surface of the photoreceptor 8 is superimposed onto the yellow toner image on the transfer belt 17 by the first transfer rollers 21. Similarly, a third scanning is carried out on the document by the optical system 4 using a red color decomposing filter. Then, a static latent image is developed using the cyan toner in the cyan developer vessel 13, thereby forming a cyan toner image. The cyan toner image is superimposed on the magenta toner image on the transfer belt 17.

Next, the second transfer roller 22, which is separated from the transfer belt 17 in the above process, comes in tight contact with the transfer belt 17. Then, a minus voltage that is higher than the surface potential of the transfer belt 17 is applied onto the second transfer roller 22. As a result, the three-layered toner image on the transfer belt 17 is transferred onto the sheet fed from the feed cassette 25 or the feed tray 26 through the register roller 24.

The sheet having transferred thereon the toner image is transported to the upper fixing portion 200*a* between the upper heat roller 201 and the intermediate heat roller 202 by the suction unit 100. In the upper fixing portion 200*a*, heat is applied from the upper and intermediate heat rollers 201 and 202 onto the three-layered full color toner image on the sheet. As a result, the full color toner image is made permanent on the sheet. In this case, a silicone oil is supplied onto the upper heat roller 201 from the oil application roller 208. This prevents offsetting of the full color toner image onto the upper heat roller 201, and also makes the full color toner image on the sheet glossy.

The sheet discharged from the upper fixing portion 200*a* of the fuser 200 reaches a discharge roller 30 through the upper discharge transport path 41. Then, the sheet is discharged onto a discharge tray 31 by a discharge roller 30.

Next, the black-and-white copying in the copying machine of the present invention will be explained below.

After the black-and-white copying mode (black-and-white single sided copying mode or black-and-white both sided copying mode) is selected by the copy selection key 52, the copy start button 53 is pressed ON. Then, the intermediate heat roller 202 is rotated in the clockwise direction. With the rotation of the intermediate heat roller 202, the lower heat roller 203 is rotated in the counterclockwise direction.

The suction unit 100 is rotated to the lower position. Here, the oil application roller 208 is separated from the upper heat roller 201.

The surface of the photoreceptor 8 is uniformly charged by the charger 9, and the document placed on the document platen 3 is scanned by the optical system 4. A light reflected from the document is projected onto the surface of the photoreceptor 8 through the optical system 4 without passing through the color decomposing filter nor the slit, thereby forming a static latent image. The static latent image is developed by the black developer vessel 10. The resulting black toner image is transferred onto the transfer belt 17, and then further transferred onto the sheet.

The sheet having transferred thereon the toner image is transported onto the lower fixing portion 200*b* between the intermediate heat roller 202 and the lower heat roller 203 by the suction unit 100, thereby making the toner image permanent on the sheet.

In the case of a single sided copying mode, the switching gate 29 is activated so that the sheet is directed to the lower discharge transport path 42. Through the lower discharge transport path 42, the sheet is discharged onto the discharge tray 31 by the discharge roller 30.

On the other hand, in the case of a both sided copying mode, the switching gate 29 is activated so that the sheet is directed to the retransport path 32. The sheet fed from the fuser 200 is discharged onto the intermediate tray 33 through the retransport path 32. Thereafter, the sheet on the intermediate tray 33 is fed to the reverse and retransport path 35 by the feed roller 34, and after being reversed by the reverse and retransport path 35, the sheet reaches the register roller 24.

Next, the surface of the photoreceptor 8 is charged again by the charger 9. Then, the reversed document on the document platen 3 is scanned by the optical system 4. In the same manner as the aforementioned mode, the toner image is transferred onto the back surface of the sheet. Then, the toner image is made permanent on the sheet in the lower fixing portion 200*b*. Here, the switching gate 29 is activated so that the sheet is directed to the lower discharge transport path 42. Then, the sheet is transported to the discharge roller 30 through the lower discharge transport path 42 by the switching gate 29, and is discharged onto the discharge tray 31 through the discharge roller 30.

As described, the fuser 200 in the copying machine of the present embodiment is arranged such that the upper fixing portion 200*a* between the upper heat roller 201 and the intermediate heat roller 202 associated with the fixing in the full-color copying process, and the lower fixing portion 200*b* between the intermediate fixing roller 202 and the lower fixing roller 203 associated with the black-and-white copying. This arrangement has the following advantage.

The respective fixing conditions of the upper and lower fixing portions can be separately set for the black-and-white copying and the full color copying. This enables the optimum fixing processes to be achieved both for the black-and-white copying and for the full color copying without requiring the complicated control system of the fuser 200.

The fixing process in the black-and-white copying mode is carried out in the lower fixing portion 200*b* formed between the intermediate and lower heat rollers 202 and 203 made of durable and low-priced material. Therefore, the intermediate and lower heat rollers 202 and 203 are not required to be frequently exchanged, thereby reducing the cost for the black-and-white copying process.

In the above arrangement, since the silicon oil used for the upper heat roller 201 is not likely to adhere onto the sheet having gone through the fixing process in the lower fixing portion 200*b*. Namely, since the silicone oil does not adhere to the retransport path 32 nor the reverse and retransport path 35, the transporting ability is not reduced, thereby eliminating the problem of the, sheet being stuck in the apparatus. Moreover, since the silicone oil does not adhere onto the photoreceptor, etc., nor get inserted in the developer vessels, the image quality will not be reduced.

The fuser 200 of the copying machine of the present embodiment is arranged such that the upper fixing portion 200*a* associated with the full color copying process, and the lower fixing portion 200*b* is associated with both single sided and both sided black-and-white copying processes. This provides the upper discharge transport path 41, the lower discharge transport path 42, and the retransport path 32 without having a crossing point. Therefore, the structure can be simplified.

Next, with the above arrangement of the copying machine of the present embodiment, the black-and-white/full color both sided copying process will be explained below.

After the black-and-white/full color both sided copying mode is selected by the copy selection key 52, the copy start button 53 is pressed ON. Then, the black-and-white copying process is carried out on one surface of the sheet. More concretely, the intermediate heat roller 202 is rotated in the clockwise direction. With the rotation of the intermediate heat roller 202, the lower heat roller 203 is rotated in the counterclockwise direction. Further, the suction unit 100 is rotated to the lower position. The black-and-white copying process is carried out in this state, and the fixing process is carried out in the lower fixing portion 200*b* on the sheet having transferred thereon the toner image. Thereafter, the sheet is transported to the register roller 24 through the retransport path 32, the intermediate tray 33, and the reverse and retransport path 35.

Then, the full color copying process is carried out on the other surface of the sheet. More concretely, the intermediate heat roller 202 is rotated in the counterclockwise direction. With the rotation of the intermediate heat roller 202, the upper heat roller 201 is rotated in the clockwise direction. Further, the oil application roller 208 is made in tight contact with the upper heat roller 201, and the suction unit 100 is rotated to the upper position. In this state, the full color copying process is carried out.

As described, in the both sided black-and-white/full color copying mode, after carrying out the black-and-white copying process on one surface of the sheet, the full color copying process is carried out on the other surface of the sheet. Therefore, the full color copied sheet which is easily rolled by making the three-layered toner image permanent, nor the full color copied sheet with the silicone oil adhering thereto will not be transported to the retransport path 32 or to the reverse and retransport path 35 of the reverse and retransport unit 2. This prevents the occurrence of the following problem when adopting the silicone oil: the sheet is stuck in the reverse and retransport unit 2, the quality of the image is reduced, etc.

In the arrangement of the present embodiment, the reverse and retransport unit 2 is provided in the lower part of the copying machine. In order to form both upper and lower fixing portions 200*a* and 200*b*, three heat rollers 201 through 203 are set parallel in up-down direction, and the lower fixing portion located closer to the reverse and retransport unit 2 than the upper fixing portion is set associated with the black-and-white copying process. However, the present invention is not limited to the above arrangement as long as the arrangement is made in such a way that the fixing portion located closer to the reverse and retransport unit 2 is associated with the black-and-white copying, and the other fixing portion is associated with the color copying. For example, in the case where the reverse and retransport unit 2 is provided near the side of the copying machine, in order to form one fixing portion on the left side and the other fixing portion on the right side, the three heat rollers may be set parallel in horizontal direction, and the fixing portion located closer to the reverse and retransport unit is set for the black-and-white copying process.

As described, the electrophotographic printing machine in accordance with the present invention is arranged so as to comprise:

image forming means for selectively forming a monochrome image or a color image on a surface of a recording material;

fixing means which includes a first fixing portion and a second fixing portion, the first fixing portion being used for fixing a color image onto the surface of the recording material, and the second fixing portion being used for fixing a monochrome image onto the surface of the recording material;

recording material transport means for conveying the recording material with the color image thereon to the first fixing portion and for conveying the recording material with the monochrome image thereon to the second fixing portion;

reverse and retransport means for reversing the recording material having passed through the second fixing portion and retransporting it to the image forming means;

a first discharge transport path for guiding the recording material having passed through the first fixing portion out of the device;

a second discharge transport path for guiding the recording material having passed through the second fixing portion out of the device;

a retransport path for guiding the recording material having passed through the second fixing portion to the reverse and retransport means;

transport direction switching means for switching a transport direction of the recording material having passed through the second fixing portion between the second discharge transport path and the retransport path; and control means for controlling respective operations of the image forming means, fixing means, recording material transport means, reverse and retransport means, and transport direction switching means according to a process selected between monochrome and color, and between single sided or both sided of the recording material, and wherein:

the second fixing portion is provided closer to the reverse and retransport means than the first fixing portion.

In the above arrangement, the first fixing portion is a fixing portion associated with the color image forming process, and the second fixing portion is a fixing portion associated with the monochrome image forming process. This permits separate setting of the respective fixing conditions for the color image forming process of the first fixing portion and the monochrome image forming process of the second fixing portion. Therefore, a complicated control system is not required for the fixing means. This permits achievement of the optimum fixing process in both color image forming process and the monochrome image forming process.

The electrophotographic printing machine of the present embodiment is arranged that the fixing means includes first through third fixing rollers, and fixing roller drive means for rotating the first through third fixing rollers;

the first fixing roller is in tight contact with the second fixing roller, and the second fixing roller is in tight contact with the third fixing roller; and the first fixing portion is formed in a contacting portion between the first fixing roller and the second fixing roller, whereas, the second fixing portion is formed in a contacting portion between the second fixing roller and the third fixing roller.

In the above arrangement, for the second fixing portion associated with the monochrome image forming process, a durable and low-priced fixing roller may be used, the fixing roller is not required to be exchange often with a new one, and the cost for the monochrome image forming process can be reduced.

Additionally, even when the arrangement is made such that an oil is supplied to the first fixing roller, the oil is not likely to adhere to the recording material to be processed in the second fixing portion. Thus, the problem of the sheet being stuck in the apparatus can be eliminated.

Further, the first discharge transport path, the second discharge transport path, and the retransport path can be provided without having any crossing point. This permits a simplified structure of the transport paths.

In the above arrangement of the electrophotographic printing machine in accordance with the present embodiment, monochrome/color image forming processes are permitted wherein the monochrome image is formed on one surface of the recording material, and the color image is formed on the other surface of the recording material As described, in the monochrome/color image forming processes, the control means controls the toner image forming means, the fixing means, the recording material transport means, the reversing and transporting means, and the transport direction switching means so that after carrying out the monochrome image forming process on one surface of the recording material, the color image forming process is carried out on the other surface of the recording material.

Therefore, the recording material with the color image formed thereon which is easily rolled and with the silicone oil adhering thereto will not be transported neither to the retransport path nor to the reverse and retransport means. This prevents the occurrence of the problem that the recording material is stuck in the retransport path or in the reverse and retransport means, thereby permitting a reliable both sided monochrome/-color image forming process.

The following description will discuss another embodiment of the present invention with reference to FIGS. 1 through 7(*d*). A full color copying machine (hereinafter simply referred to as a copying machine) of the present embodiment as an example of the electrophotographic printing machines has the same configuration as the copying machine of the first embodiment shown in FIGS. 1 through 5. For convenience, members having the same function as in the first embodiment will be designated by the same code and their description will be omitted.

Figure 6:
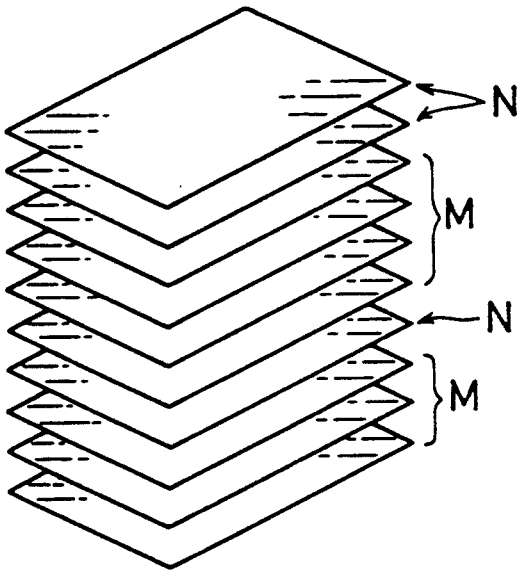
Figure 7A:
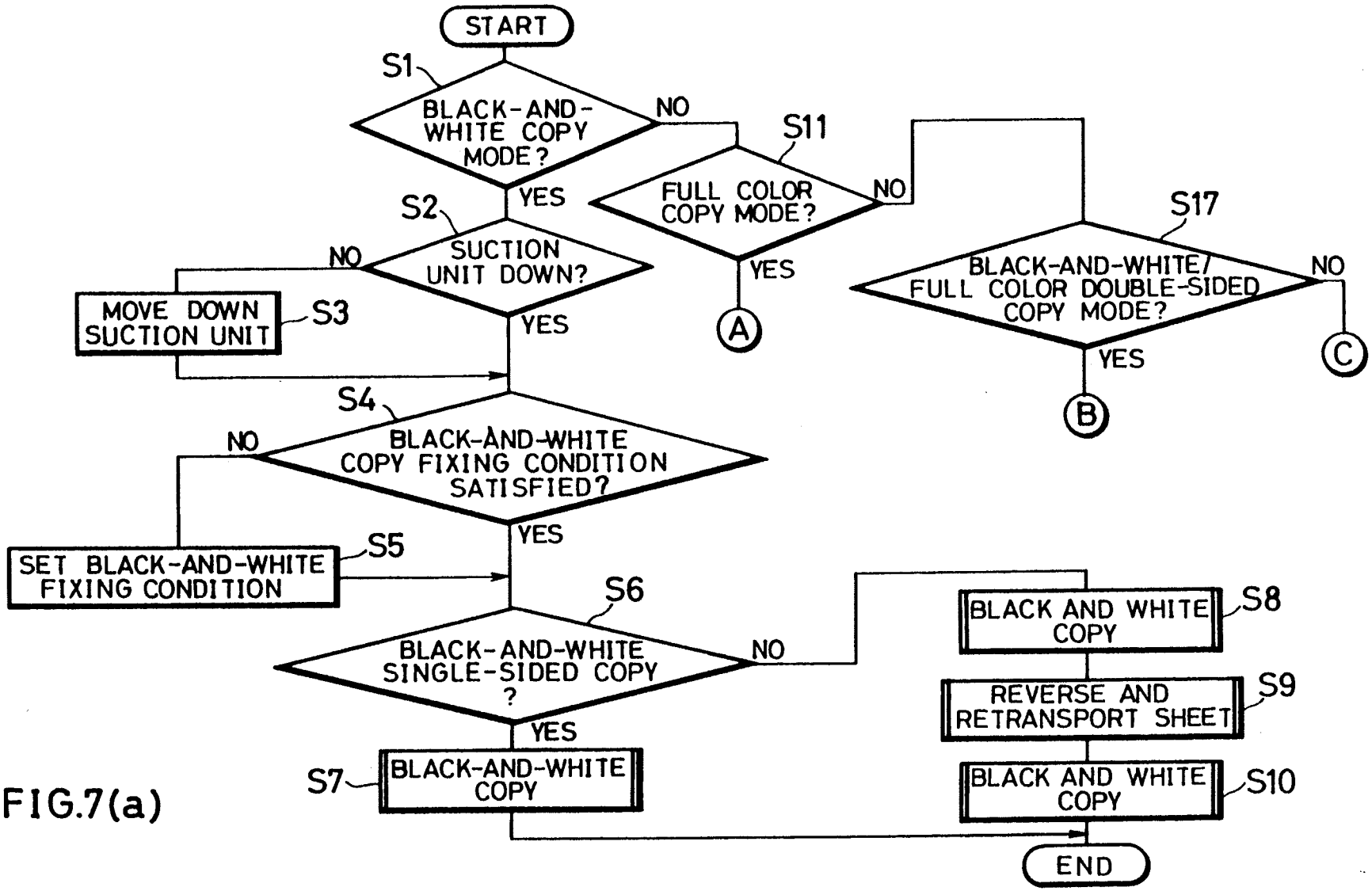
Figure 7B:
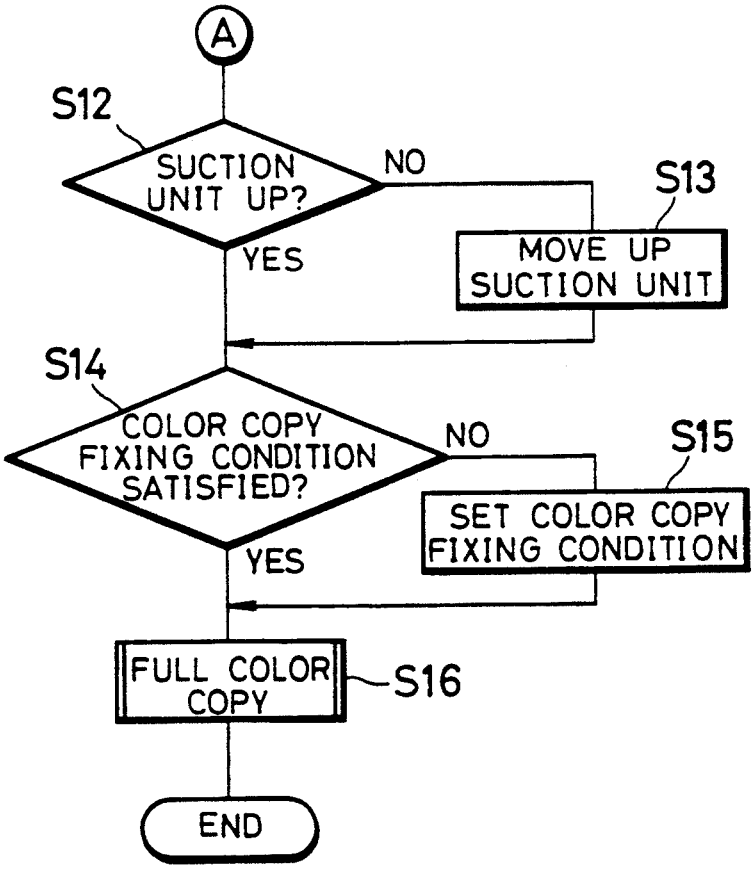
Figure 7C:
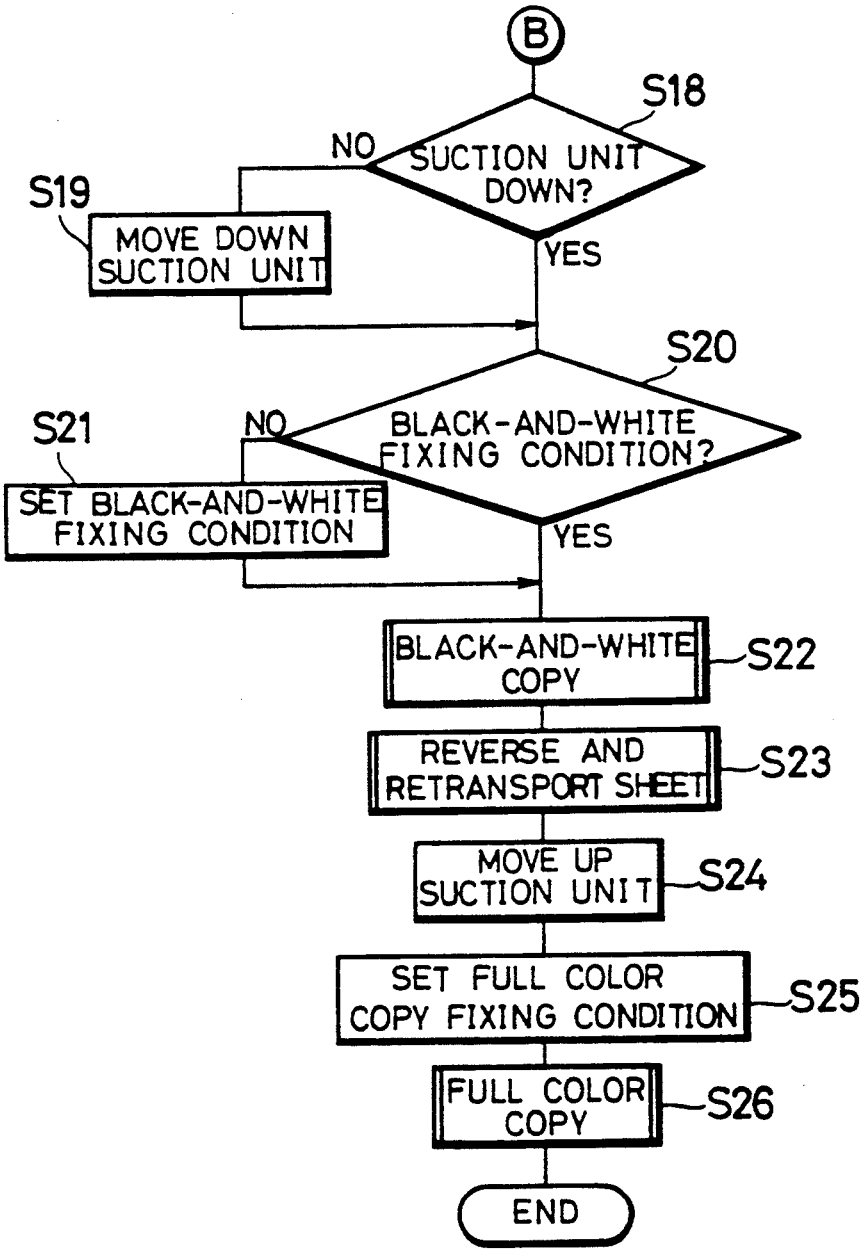
Figure 7D:
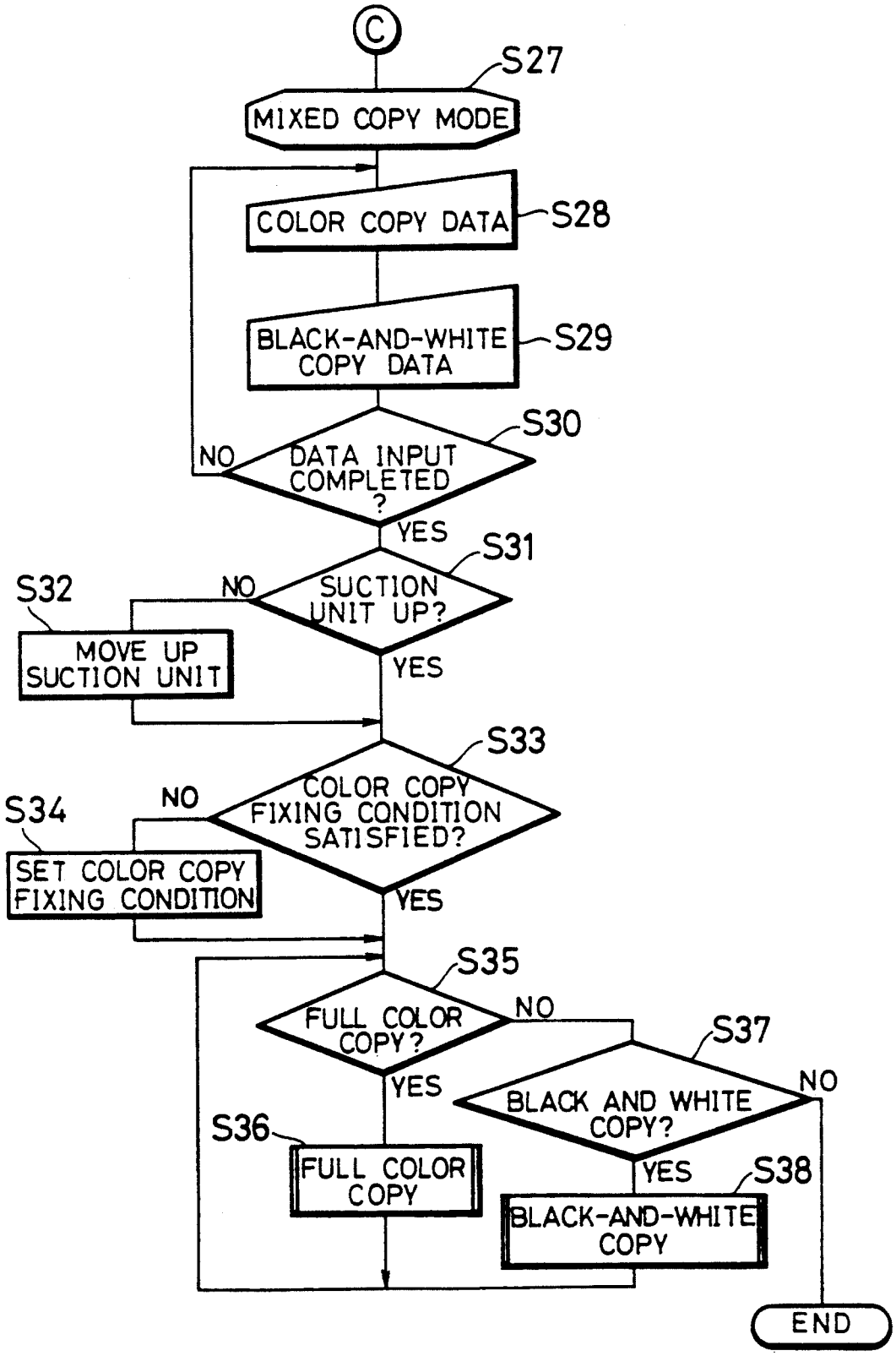
Figure 8:
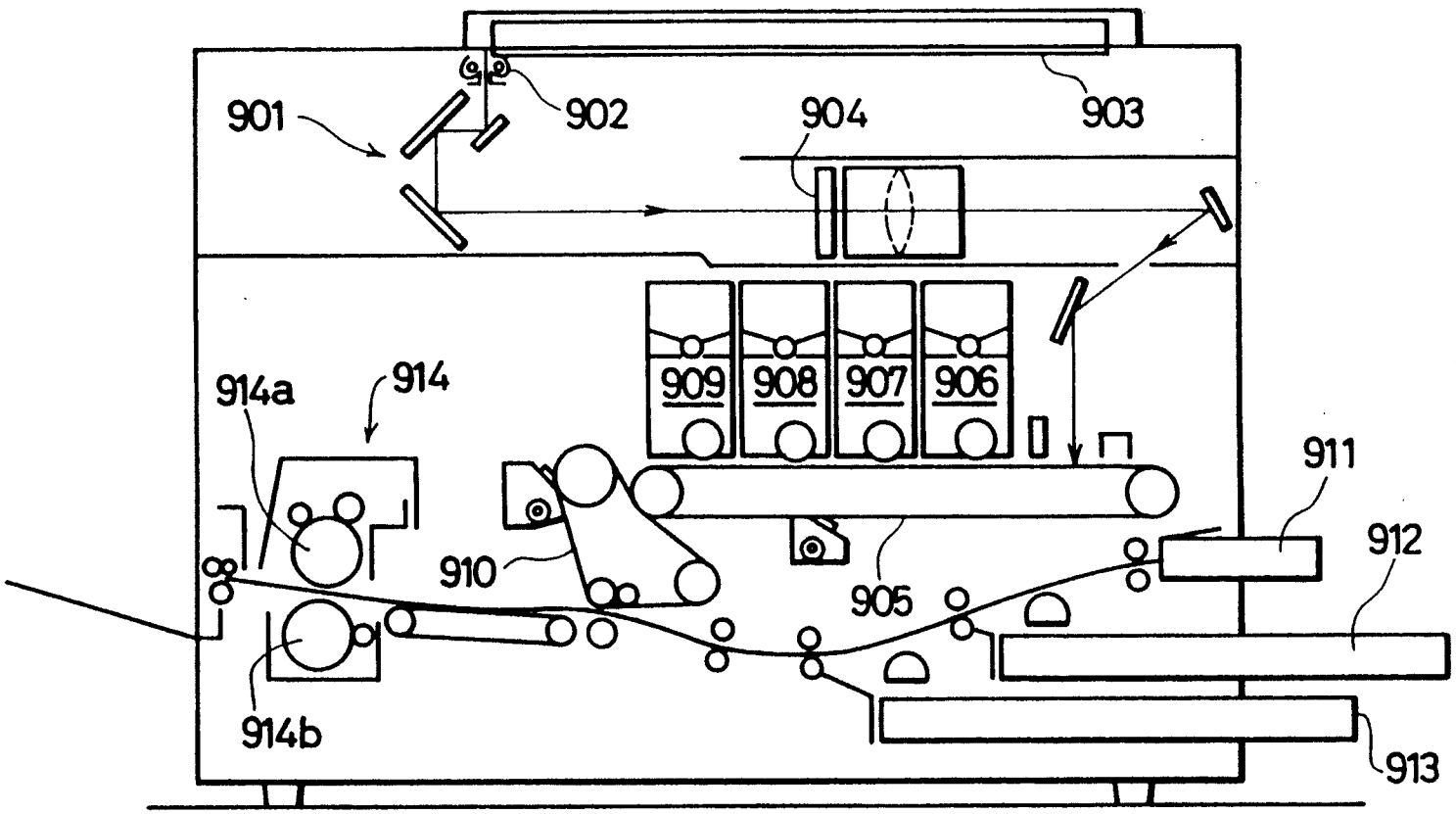
FIG. 8 PRIOR ART
FIG. 8 is a view showing an entire configuration of the conventional copying machine.

As in the case of the copying machine of the first embodiment, in the copying machine of the present embodiment, the following copying modes are permitted: a single sided black-and-white image copying mode and a single-side full color image copying mode; both sided black-and-white image copying mode; both sided black-and-white/full color image copying mode wherein the black-and-white image is copied on one surface of the sheet, and the full color image is copied on the other surface of the sheet; and a mixed copying mode wherein a single sided copying process is successively carried out with respect to a plurality of documents including both those with black-and-white image and those with full color image. In the mixed copying mode, an example is shown in FIG. 6 wherein the first, second and seventh documents N are the color image documents, and the third, fourth, fifth, sixth, eighth, ninth, and tenth documents M are black-and-white documents, the copying of the documents can be carried out successively only by pressing a start button 53 once (see FIG. 4).

In the mixed copying mode, first the mixed copying mode is selected by pressing the copy selection key 52 (see FIG. 4). Thereafter, the documents associated with the full color image copying mode, and the documents associated with the black-and-white image copying mode are specified using an operation key (not shown).

Next, the control operations of the control unit 51 shown in FIG. 4, are explained for each mode of the black-and-white image copying mode, the full color image copying mode, the both sided black-and-white/-full color copying mode, and the mixed copying mode with reference to FIGS. 7(*a*) through 7(*d*).

In the copying machine of the present embodiment, it is set either in one of the following modes: the single sided black-and-white image copying mode, both sided black-and-white image copying mode, full color image copying mode, both sided black-and-white/full color image copying mode, and mixed copying mode, and the change in the mode is permitted by the copy selection key 52 (see FIG. 4).

As shown in FIG. 7(*a*), when the copying process is started by pressing the start button 53, it is determined whether or not the black-and-white image copying mode (single sided black-and-white image copying mode or both sided black-and-white image copying mode) is selected (Step 1, the Step is hereinafter referred to as S).

If it is set in the black-and-white image copying mode in S1, it is determined whether or not the suction unit 100 is set in a predetermined lower position (S2). If not, the suction unit 100 is rotated in the lower position (S3).

After determining that the suction unit 100 is set in the predetermined lower position in S2, or after rotating the suction unit 100 in the predetermined lower position in S3, it is determined whether or not the fuser 200 satisfies the fixing condition for the black-and-white copying (S4). More concretely, in S4, it is determined whether or not an intermediate heat roller 202 is rotated in the clockwise direction, and whether or not the surface temperature of the intermediate and lower heat rollers 202 and 203 reach the predetermined temperature. If not in S4, the fuser 200 is set so as to satisfy the fixing conditions for the black-and-white copying process (S5).

After determining that the fuser 200 satisfies the fixing condition for the black-and-white copying in S4, or after setting the fuser 200 so as to satisfy the fixing condition for the black-and-white copying in S5, it is determined whether or not the selected mode is the single sided black-and-white image copying mode (S6). If so in S6, the control of the black-and-white image copying process is carried out (S7). If not in S6, after carrying out the control of the black-and-white image copying process (S8), the sheet discharged from the fuser 200 is reversed and retransported to the main body 1 by the reverse and retransport unit 2 (S9). Then, the control of the black-and-white copying is carried out with respect to the back surface of the sheet (S10).

If not in S1, it is determined whether or not the selected mode is the full color copying mode (S11). If so, as shown in FIG. 7(*b*), it is determined whether or not the suction unit 100 is set in the upper position (S12). If not, the suction unit 100 is rotated to the upper position (S13).

After determining that the suction unit 100 is set in the upper position in S12, or after rotating the suction unit 100 to the upper position in S13, it is determined whether or not the fuser 200 satisfies the fixing condition for the full color copying (S14). More concretely, in S14, it is determined whether or not the intermediate roller 202 is rotated in the counterclockwise direction, and the surface temperatures of the upper and intermediate rollers 201 and 202 reach the predetermined temperature. If not in S14, the fuser 200 is set so as to satisfy the fixing condition for the full color copying (S15).

After determining that the fuser 200 satisfies the fixing condition for the full color copying in S14, or after the fuser 200 is set so as to satisfy the fixing condition for the full color copying in S15, the control of the full color copying process is carried out (S16).

If not in S11, as shown in the flow chart of FIG. 7(*a*), it is determined whether or not the selected mode is the two sides black-and-white/full color image copying mode (S17). If so in S17, S18 through S21 shown in the flow chart of FIG. 7(*c*) are carried out. As the control processes in S18 through S21 are the same as those of aforementioned S2 through S5, the explanations thereof shall be omitted here.

After carrying out the control of the black-and-white copying process (S22), the sheet discharged from the fuser 200 is reversed and retransported to the main body 1 through the reverse and retransport unit 2 (S23). Then, the suction unit 100 is rotated to the upper position (S24), and the fuser 200 is set so as to satisfy the fixing condition of the full color copying process (S25). Thereafter, the control of the full color copying process is carried out (S26).

When the selected mode is a mixed copying mode, it is determined NO in S17 shown in the flow chart of FIG. 7(*a*), and the preparation for the mixed copying mode is carried out as shown in the flow chart of FIG. 7(*d*) (S27). Then, the data regarding the number of the full color copying and which documents from the top are associated with the full color copying are input (S28), thereafter, the data regarding the number of the black-and-white copying and which documents from the top are associated with the black-and-white copying are input (S29). Then, it is determined weather or not input of all the data have been completed (S30). In S30, it may be arranged such that when any data is not input for a predetermined time, it is determined that the input of all the data has been completed. If it is determined that input of all the data has not been completed, S15 and S16 are repeated. If completed, S31 through S34 are carried out. As the processes in S31 through S34 are the same as those of S12 through S15 in the full color copying mode shown in the flow chart of FIG. 7(*b*), the explanations thereof shall be omitted here.

Based on the input data regarding the full color copying and the black-and white copying respectively input in S28 and S29, it is determined whether or not the first document is associated with the full color image (S35). If so in S35, the control of the full color copying process is carried out (S36). If not in S35, it is determined whether or not the first document is associated with the black-and-white image (S37). If so in S37, the control of the black-and-white copying is carried out (S38).

For the following documents, S35 through S38 are repeated, and after copying of all the document is completed, it is determined NO in S37, and the successive copying process is completed.

As described, in the copying machine of the present embodiment, when it is set in the mixed copying mode, in both full color and the black-and-white copying processes, the fixing of the toner image onto the sheet is carried out in the upper fixing portion 200*a* formed in the contacting portion between the upper heat roller 201 and the intermediate heat roller 202. Here, since the upper fixing portion 200*a* is set so as to satisfy the condition for the full color copying, it can be used for both black-and-white and full color copying processes.

In the conventional copying machine, when it is set in the mixed copying mode, the fixing portion provided only for the color copying (corresponding to the upper fixing portion 200*a* of the present embodiment) is used in the color copying process, and the fixing portion provided only for the black-and-white copying process is used in the black-and-white copying process. In this arrangement, each time switching from the black-and-white copying process to the full color copying process, the suction unit must be moved. Moreover, the rotating direction and the temperature are required to be adjusted for each of the upper, the intermediate, and the lower heat rollers. Therefore, a longer time is required for the mixed copying process compared with the normal successive copying process, and the user may have a feeling of disorder or discomfort.

On the other hand, the copying machine of the present embodiment does not require the switching of the suction unit 100, nor the rotation direction and temperature are required to be adjusted for each of the upper, intermediate, and lower heat rollers. This enables the successive copying process to be carried out effectively with a reduced time loss in the mixed copying mode. Therefore, the user feels that the successive copying process in the mixed copying mode is carried out just like the normal successive copying process, and the user will not have a feeling of discomfort for the waiting time.

As described, the electrophotographic printing machine in accordance with the present embodiment comprises:

image forming means for selectively forming a monochrome image or color image on a surface of the recording material;

fixing means including a first fixing portion and a second fixing portion, the first fixing portion being used for fixing both monochrome and color images onto the surface of the recording materials, and the second fixing portion being used for fixing a monochrome image onto the surface of the recording material;

recording material transport means for conveying both the recording material with a monochrome image thereon and the recording material with the color image thereon to the first transport portion, and for conveying only the recording material with the monochrome image thereon to the second transport portion; and control means for controlling respective operations of the image forming means, fixing means, and recording material transport means according to a process selected between monochrome and color, and wherein:

in the successive image forming process wherein monochrome image forming processes and color image forming processes are combined, the control means controls the recording material transport means so that all the recording materials with the monochrome or color images thereon are transported to the first fixing portion, and controls the fixing means so that the monochrome and color images formed on the recording materials are permanently affixed thereto in the first fixing portion.

With the above arrangement, when the successive image forming process wherein the monochrome and the color image forming process are mixed, the switching of the transporting direction of the recording material in the recording material transport means nor switching between the first fixing portion and the second fixing portion in the fixing means is required, thereby enabling a prompt successive copying process with a reduced time loss.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic printing machine designed for both single sided and both sided monochrome image forming processes, and for a single sided color image forming process, comprising:

image forming means for selectively forming a monochrome image or a color image on the surface of a recording material;

fixing means which includes a first fixing portion and a second fixing portion, said first fixing portion being sued for fixing a color image onto the surface of the recording material, and said second fixing portion being used for fixing a monochrome image onto the surface of the recording material;

recording material transport means for conveying the recording material with the color image thereon to said first fixing portion and for conveying the recording material with the monochrome image thereof to said second fixing portion;

reverse and retransport means for reversing the recording material having passed through said second fixing portion and retransporting it to said image forming means;

a first discharge transport path for guiding the recording material having passed through said first fixing portion out of the electrophotographic printing machine;

a second discharge transport path for guiding the recording material having passed through said second fixing portion out of the electrophotographic printing machine;

a retransport path for guiding only the recording material having passed through said second fixing portion to said reverse and retransport means;

transport direction switching means for switching a transport direction of the recording material having passed through said second fixing portion between said second discharge transport path and said retransport path; and control means for controlling respective operations of said image forming means, fixing means, recording material transport means, reverse and retransport means, and transport direction switching means according to a process selected between monochrome and color, and between single sided and both sided of the recording material, and wherein;

said second fixing portion is provided closer to said reverse and retransport means than said first fixing portion so that said retransport path will not cross said first discharge transport path and said second discharge transport path;

the recording material is guided to said reverse and retransport means only through said reverse and retransport path, and the recording material with a color image thereof having passed trough said reverse and retransport path.

2. The electrophotographic printing machine as set forth in claim 1, wherein:

said fixing means includes first through third fixing rollers, and fixing roller drive means for rotating said first through third fixing rollers;

said first fixing roller is in tight contact with said second fixing roller, and said second fixing roller is in tight contact with the third fixing roller; and said first fixing portion is formed in a contacting portion between said first fixing roller and said second fixing roller, whereas, said second fixing portion is formed in a contacting portion between said second fixing roller and said third fixing roller.

3. The electrophotographic printing machine as set forth in claim 2, wherein:

said first through third fixing rollers respectively include heating means in inner portions thereof.

4. The electrophotographic printing machine as set forth in claim 3, wherein:

each of said heating means includes a heater lamp.

5. The electrophotographic printing machine as set forth in claim 3, wherein:

respective surfaces of said first and third fixing rollers are made of elastic material, and a surface of said second fixing roller is made of inelastic material.

6. The electrophotographic printing machine as set forth in claim 5, wherein:

the elastic material is a silicone rubber.

7. The electrophotographic printing machine as set forth in claim 5, wherein:

said inelastic material is polytetrafluoroethylene.

8. The electrophotographic printing machine as set forth in claim 5, wherein:

said first fixing roller has a smooth surface.

9. The electrophotographic printing machine as set forth in claim 5, further comprising:

oil supply means for supplying an oil on a surface of said first fixing roller.

10. The electrophotographic printing machine as set forth in claim 9, wherein said oil supply means includes:

an oil application roller being oil moistened; and an oil application roller drive means for activating said oil application roller so as to come in tight contact with the surface of said first fixing roller when said first fixing portion is used, whereas, activating said oil application roller so as to be separated from the surface of said first fixing roller when said first fixing portion is not used.

11. The electrophotographic printing machine as set forth in claim 2, wherein:

said fixing roller drive means rotates said second fixing roller in a normal or reverse direction depending on whether said first fixing portion or said second fixing portion is used; and said first and third fixing rollers are driven so as to rotate with the rotation of said second fixing roller.

12. The electrophotographic printing machine as set forth in claim 1, wherein:

said recording material transport means includes a transport belt with no ends which is capable of moving; and transport belt drive means for selectively moving a transport direction side end of said transport belt between said first fixing portion and said second fixing portion.

13. The electrophotographic printing machine as set forth in claim 1, wherein said reverse and retransport means includes:

an intermediate tray for placing thereon the recording material fed through said retransport path;

reverse transport path for reversing the recording material fed from said intermediate tray and retransporting it to said image forming means; and recording material feeding means for feeding the recording material placed on said intermediate tray to said reverse transport path.

14. The electrophotographic printing machine as set forth in claim 1, wherein:

said transport direction switching means is a switching gate provided in a branch point between said second discharge transport path and said retransport path.

15. An electrophotographic printing machine designed for both single sided and both sided monochrome image forming processes, a single sided color copying process, and a both sided monochrome/color image forming process wherein a monochrome image is formed on one surface of a recording material and a color image is formed on the other surface of the recording material, comprising:

image forming means for selectively forming a monochrome image or color image on a surface of a recording material;

fixing means including a first fixing portion and a second fixing portion, said first fixing portion being used for fixing a color image onto the surface of the recording material, and said second fixing portion being used for fixing a monochrome image onto the surface of the recording material;

recording material transport means for conveying the recording material with the color image thereon to said first fixing portion, and for conveying the recording material with the color image thereon to said first fixing portion, and for conveying the recording material with the monochrome image thereon to said second fixing portion;

reverse and retransport means for reversing the recording material having passed through said second fixing portion, and for retransporting it to said image forming means;

a first discharge transport path for guiding the recording material having passed through said first fixing portion out of the electrophotographic printing machine;

a second discharge transport path for guiding the recording material having passed through said second fixing portion out of the electrophotographic printing machine;

a retransport path for guiding only the recording material having passed through said second fixing portion to the reverse and retransport means;

transport direction switching means for switching a transport direction of the recording material having passed through said second fixing portion to a direction toward said second discharge transport path or to a direction toward said retransport path; and control means for controlling respective operations of said image forming means, reverse and retransport means, and transport direction switching means according to a process selected between monochrome and color, and between single sided and both sided of the recording material, and wherein:

said second fixing portion is provided closer to said reverse and retransport means than said first fixing portion so that said retransport path will not cross said first discharge transport path and said second discharge transport path;

the recording material is guided to said reverse and retransport means only through said reverse and retransport path, and the recording material with a color image thereon having passed through said first fixing portion is not passed through said reverse and retransport path; and in the monochrome/color both sided image forming process, said control means controls said image forming process, said control means controls said image forming means, fixing means, recording material transport means, reverse and retransport means, and transport direction switching means so that after forming the monochrome image on one surface of the recording material, the color image is formed on the other surface of the recording material.

16. The electrophotographic printing machine as set forth in claim 15, wherein:

said fixing means includes first through third fixing rollers, and fixing roller drive means for rotating said first through third fixing rollers;

said first fixing roller is in tight contact with said second fixing roller, and said second fixing roller is in tight contact with the third fixing roller; and said first fixing portion is formed in a contacting portion between said first fixing roller and said second fixing roller, whereas, said second fixing portion is formed in a contacting portion between said second fixing roller and said third fixing roller.

17. The electrophotographic printing machine as set forth in claim 16, wherein:

said first through third fixing rollers respectively include heating means in inner portions thereof.

18. The electrophotographic printing machine as set forth in claim 17, wherein:

each of said heating means includes a heater lamp.

19. The electrophotographic printing machine as set forth in claim 17, wherein:

respective surfaces of said first and third fixing rollers are made of elastic material, and a surface of said second fixing roller is made of inelastic material.

20. The electrophotographic printing machine as set forth in claim 19, wherein:

the elastic material is a silicone rubber.

21. The electrophotographic printing machine as set forth in claim 19, wherein:

said inelastic material is polytetrafluoroethylene.

22. The electrophotographic printing machine as set forth in claim 19, wherein:

said first fixing roller has a smooth surface.

23. The electrophotographic printing machine as set forth in claim 19, further comprising:

oil supply means for supplying an oil on a surface of said first fixing roller.

24. The electrophotographic printing machine as set forth in claim 23, wherein said oil supply means includes:

an oil application roller being oil moistened; and an oil application roller drive means for activating said oil application roller so as to come in tight contact with the surface of said first fixing roller when said first fixing portion is used, whereas, activating said oil application roller so as to be separated from the surface of said first fixing roller when said first fixing portion is not used.

25. The electrophotographic printing machine as set forth in claim 16, wherein:

said fixing roller drive means rotates said second fixing roller in a normal or reverse direction depending on whether said first fixing portion or said second fixing portion is used; and said first and third fixing rollers are driven so as to rotate with the rotation of said second fixing roller.

26. The electrophotographic printing machine as set forth in claim 15, wherein:

said recording material transport means includes a transport belt with no ends which is capable of moving; and transport belt drive means for selectively moving a transport direction side end of said transport belt between said first fixing portion and said second fixing portion.

27. The electrophotographic printing machine as set forth in claim 15, wherein said reverse and retransport means includes:

an intermediate tray for placing thereon the recording material fed through said retransport path;

reverse transport path for reversing the recording material fed from said intermediate tray and retransporting it to said image forming means; and recording material feeding means for feeding the recording material placed on said intermediate tray to said reverse transport path.

28. The electrophotographic printing machine as set forth in claim 15, wherein:

said transport direction switching means is a switching gate provided in a branch point between said second discharge transport path and said retransport path.

29. An electrophotographic printing machine designed for at least a single sided monochrome image forming process, a single sided color image forming process, and a successive image forming process wherein monochrome image forming processes and color image forming processes are combined with respect to a plurality of documents including monochrome documents and color documents, comprising:

image forming means for selectively forming a monochrome image or color image on a surface of a recording material;

fixing means including a first fixing portion and a second fixing portion, said first fixing portion being used for fixing both monochrome and color images onto the surface of the recording material, and said second fixing portion being used for fixing a monochrome image onto the surface of the recording material;

recording material transport means for conveying both the recording material with the monochrome image thereon and the recording material with the color image thereon to said first fixing portion, and for conveying only the recording material with the monochrome image thereon to said second fixing portion; and control means for controlling respective operations of said image forming means, fixing means, and recording material transport means according to a process selected between monochrome and color, and wherein:

in the successive image forming process wherein monochrome image forming processes and color image forming processes are combined, said control means controls said recording material transport means so that all recording materials with the monochrome or color images thereon are transported to said first fixing portion, and controls said fixing means so that the monochrome and color images formed on the recording materials are permanently affixed thereto in said first fixing portion.

30. The electrophotographic printing machine as set forth in claim 29, wherein:

said fixing means includes first through third fixing rollers, and fixing roller drive means for rotating said first through third fixing rollers;

said first fixing roller is in tight contact with said second fixing roller, and said second fixing roller is in tight contact with the third fixing roller; and said first fixing portion is formed in a contacting portion between said first fixing roller and said second fixing roller, whereas, said second fixing portion is formed in a contacting portion between said second fixing roller and said third fixing roller.

31. The electrophotographic printing machine as set forth in claim 30, wherein:

said first through third fixing rollers respectively include heating means in inner portions thereof.

32. The electrophotographic printing machine as set forth in claim 31, wherein:

each of said heating means includes a heater lamp.

33. The electrophotographic printing machine as set forth in claim 31, wherein:

respective surfaces of said first and third fixing rollers are made of elastic material, and a surface of said second fixing roller is made of inelastic material.

34. The electrophotographic printing machine as set forth in claim 33, wherein:

the elastic material is a silicone rubber.

35. The electrophotographic printing machine as set forth in claim 33, wherein:

said inelastic material is polytetrafluoroethylene.

36. The electrophotographic printing machine as set forth in claim 33, wherein:

said first fixing roller has a smooth surface.

37. The electrophotographic printing machine as set forth in claim 33, further comprising:

oil supply means for supplying an oil on a surface of said first fixing roller.

38. The electrophotographic printing machine as set forth in claim 37, wherein said oil supply means includes:

an oil application roller being oil moistened; and an oil application roller drive means for activating said oil application roller so as to come in tight contact with the surface of said first fixing roller when said first fixing portion is used, whereas, activating said oil application roller so as to be separated from the surface of said first fixing roller when said first fixing portion is not used.

39. The electrophotographic printing machine as set forth in claim 30, wherein:

said fixing roller drive means rotates said second fixing roller in a normal or reverse direction depending on whether said first fixing portion or said second fixing portion is used; and said first and third fixing rollers are driven so as to rotate with the rotation of said second fixing roller.

40. The electrophotographic printing machine as set forth in claim 29, wherein:

said recording material transport means includes a transport belt with no ends which is capable of moving; and transport belt drive means for selectively moving a transport direction side end of said transport belt between said first fixing portion and said second fixing portion.

41. An electrophotographic printing machine designed for both single sided and both sided monochrome image forming processes, a single sided color image forming process, a both sided monochrome/color image forming process for forming a monochrome image on one surface of a recording material and forming a color image on the other surface of the recording material, and for a successive image forming process wherein the single sided monochrome image forming processes and the single sided color image forming processes are combined with respect to a plurality of documents including monochrome documents and color documents, comprising:

image forming means for selectively forming a monochrome image or color image on a surface of the recording material;

fixing means including a first fixing portion and a second fixing portion, said first fixing portion being used for fixing both monochrome and color images onto the surface of the recording materials, and said second fixing portion being used for fixing a monochrome image onto the surface of the recording material;

recording material transport means for conveying both the recording material with the monochrome image thereon and the recording material with the color image thereon to said first fixing portion, and for conveying only the recording material with the monochrome image thereon to said second fixing portion;

reverse and retransport means for reversing the recording material having passed through said second fixing portion and retransporting it to said image forming means;

a first discharge transport path for guiding the recording material having passed through said first fixing portion out of the electrophotographic printing machine;

a second discharge transport path for guiding the recording material having passed through said second fixing portion out of the electrophotographic printing machine;

a retransport path for guiding the recording material having passed through said second fixing portion to said reverse and retransport means;

transport direction switching means for switching a transport direction of the recording material having passed through said second fixing portion between said second discharge transport path and said retransport path; and control means for controlling respective operations of said image forming means, fixing means, recording material transport means, reverse and retransport means, and transport direction switching means according to a process selected between monochrome and color, and between single sided or both sided of the recording material, and wherein:

said second fixing portion is provided closer to said reverse and retransport means than said first fixing portion;

in the monochrome/color both sided image forming process, said control means controls said image forming means, fixing means, recording material transport means, reverse and retransport means, and transport direction switching means so that after forming the monochrome image on one surface of the recording material, the color image is formed on the other surface of the recording material; and in the successive image forming process wherein monochrome image forming processes and color image forming processes are combined, said control means controls said recording material transport means so that all recording materials with the monochrome or color images thereon are transported to said first fixing portion, and controls said fixing means so that the monochrome and color images formed on the recording materials are permanently affixed thereto in said first fixing portion.

* * * * *